United States Patent [19]

Escher

[11] Patent Number: 4,703,928

[45] Date of Patent: Nov. 3, 1987

[54] PRECESSIONAL EXERCISING DEVICE

[75] Inventor: James C. Escher, Swarthmore, Pa.

[73] Assignee: Gyro-Flex Corporation, Del.

[21] Appl. No.: 7,752

[22] Filed: Jan. 28, 1987

Related U.S. Application Data

[60] Division of Ser. No. 679,257, Dec. 7, 1984, Pat. No. 4,640,508, which is a continuation-in-part of Ser. No. 477,175, Mar. 21, 1983, abandoned.

[51] Int. Cl.[4] ..... A63B 21/22

[52] U.S. Cl. ..... 272/128; 272/96; 272/129; 272/132; 272/143; 272/146; 128/25 B; 74/5.22

[58] Field of Search ..... 128/36, 35, 25 B, 25 R; 74/5.22, 5.4, 64; 248/183; 272/128, 129, 132, 133, 140, 146, 96, 143; 446/233

[56] References Cited

U.S. PATENT DOCUMENTS

| | | | |
|---|---|---|---|
| 850,938 | 4/1907 | Kellogg | 128/36 |
| 1,058,786 | 4/1913 | Newkirk et al. | 272/128 X |
| 2,198,872 | 4/1940 | Hegstrom | 128/25 B |
| 2,209,160 | 7/1940 | Greenberg | 128/25 B |
| 2,581,846 | 1/1952 | Eriksson | 74/5.22 |
| 2,645,219 | 7/1953 | Bertholin | 128/36 |
| 2,882,718 | 4/1959 | Shaw | 74/5.22 |
| 3,020,046 | 2/1962 | Hotas | 272/96 |
| 3,134,591 | 5/1964 | Conn et al. | 272/96 X |
| 3,482,835 | 12/1969 | Dean | 272/128 X |
| 3,617,056 | 11/1971 | Herbold | 272/128 X |
| 3,659,844 | 5/1972 | Cummins | 272/146 X |
| 3,782,721 | 1/1974 | Passera | 272/96 X |
| 3,841,627 | 10/1974 | Vetter | 272/128 |
| 3,901,503 | 8/1975 | Klose | 272/128 X |
| 4,071,235 | 1/1978 | Zent | 272/132 X |
| 4,150,580 | 4/1979 | Silkebakken et al. | 272/128 X |

FOREIGN PATENT DOCUMENTS

| | | | |
|---|---|---|---|
| 410138 | of 1910 | France | 272/128 |

*Primary Examiner*—Richard J. Apley
*Assistant Examiner*—D. Bender
*Attorney, Agent, or Firm*—Arthur L. Lessler

[57] ABSTRACT

A precessional foot exercising device utilizing a housing containing a spinning mass which forms the rotor of a motor for spinning the mass. The spin axis of the mass is perpendicular to upper and lower surfaces of the housing. A foot plate receives the foot to be exercised. The foot plate is mounted for rotation about two mutually orthogonal axes to provide two degrees of rotational freedom of the foot. The housing is coupled to the foot plate so that the upper and lower surfaces of the housing and therefore the spin axis are rotated by rotation of the foot plate caused by rotation of the foot detachably secured thereto. Rotational movement of the foot is opposed by the gyroscopic effect of the spinning mass, producing an isometric exercise effect when the foot plate is rotated by muscles of the foot while the precessional torque of the spinning mass is opposed by other muscles of the foot.

7 Claims, 16 Drawing Figures

TIMING DIAGRAM

FIG. 13
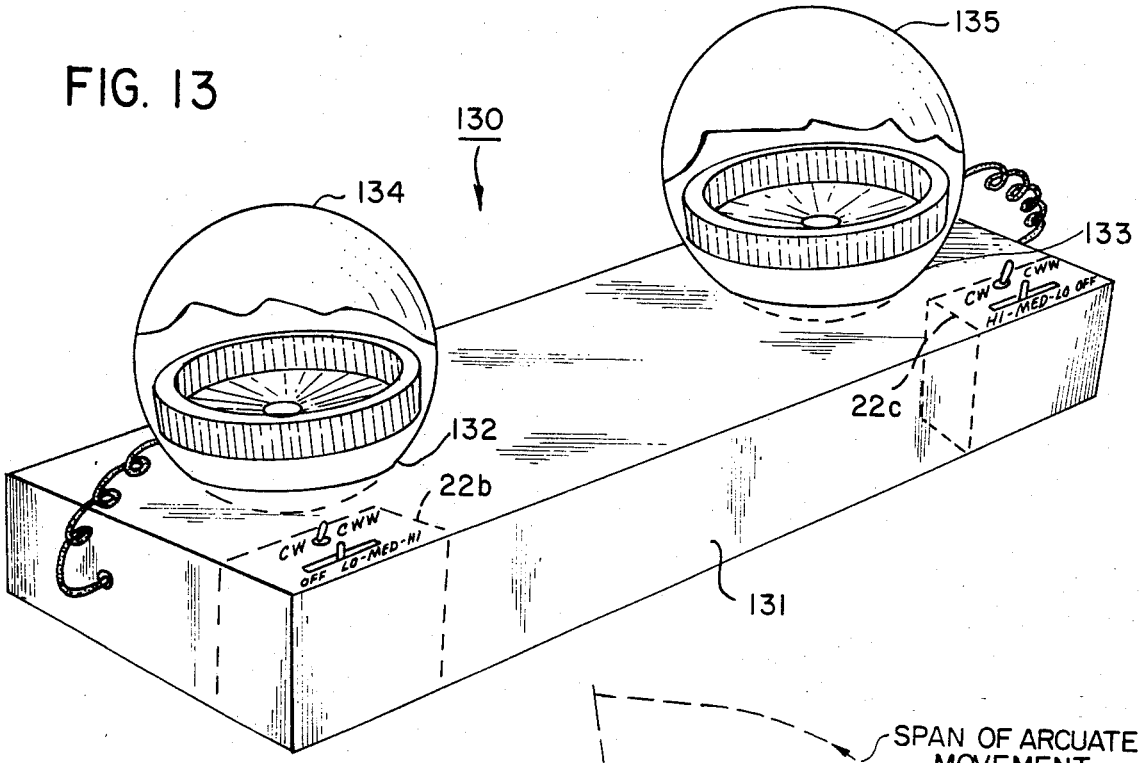
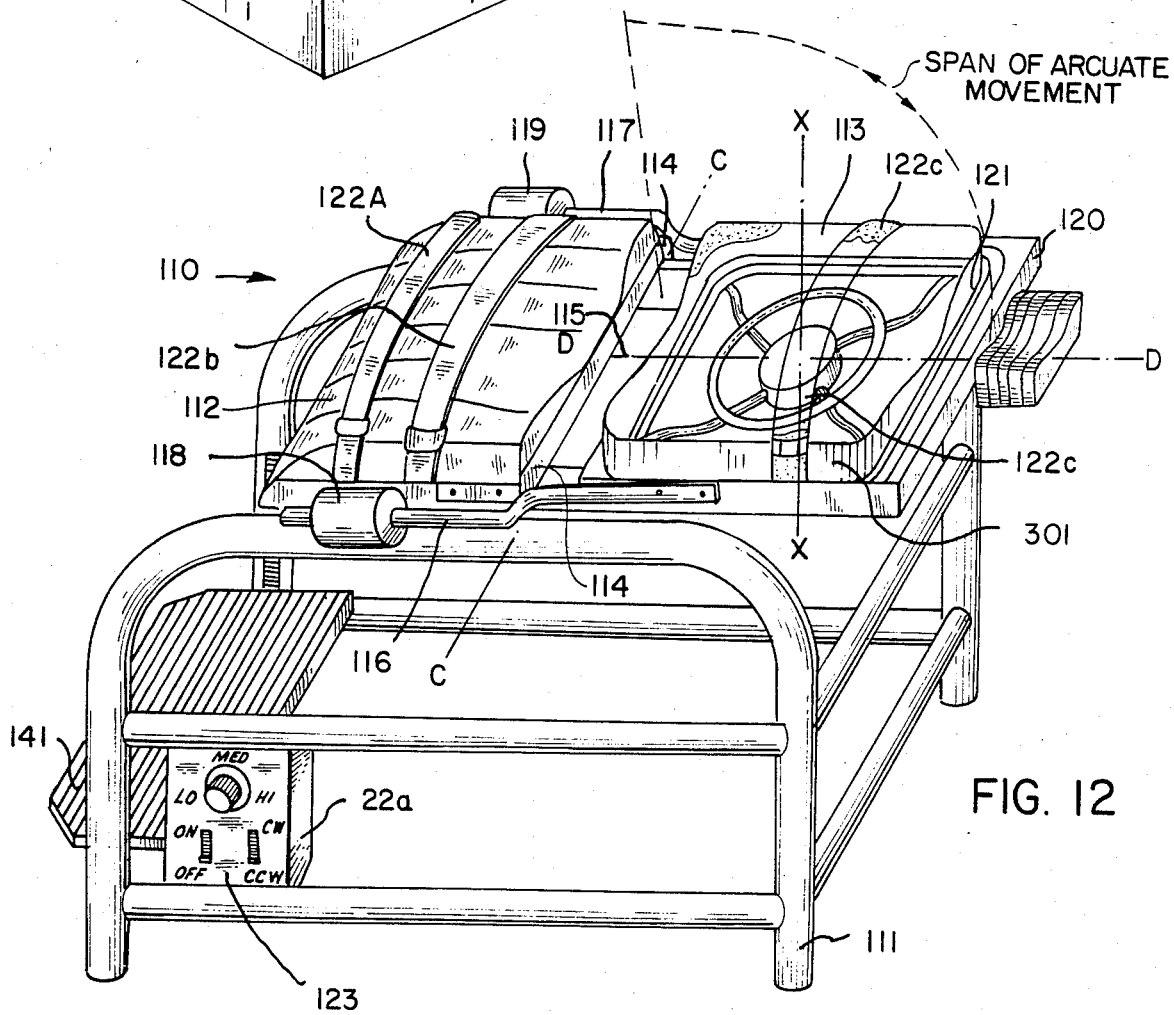
FIG. 12

PRECESSIONAL EXERCISING DEVICE

REFERENCE TO RELATED APPLICATION

This application is a division of prior copending U.S. patent application Ser. No. 679,257, filed Dec. 7, 1984, now U.S. Pat. No. 4,640,508 and assigned to the assignee of the instant application; which prior application is a continuation-in-part of prior copending U.S. patent application Ser. No. 477,175, filed Mar. 21, 1983 and assigned to the assignee of the instant application now abandoned.

BACKGROUND OF THE INVENTION

This invention relates to exercising devices which utilize the gyroscopic effect of a rapidly spinning mass to develop or strengthen selected muscles of the human body for purposes of, for example, athletic training, exercise or physical therapy.

In conventional weight training for athletes, heavy weights and dumbbells are used which, because of the strong force of gravity pulling them downward, provide a resistive force against which muscles may be exercised. Although exercising with such weights and dumbbells has many benefits, the variety and types of muscles which may be exercised are restricted.

Exercising systems based solely on weight principally benefit the flexor and extensor muscles of the body, since the weight lifting or thrusting motion consists basically of overcoming the force of gravity along a straight line. Muscle groups such as those associated with circular twisting motion or the arms and wrists, or of the feet and legs, are not appreciably exercised by use of conventional weights.

It has been known in the prior art that the precession or gyroscopic effect of a rapidly spinning mass, which is the basis of operation of gyroscopes and similar devices, may be used for purposes of exercise. This effect is capable of producing a strong torque if the user attempts to move the mass in a way which rotates its spin axis.

U.S. Pat. No. 3,617,056, issued Nov. 2, 1971 to Herbold, discloses a dumbbell utilizing the precessional effect of a spinning mass. In the embodiment shown in FIGS. 3 and 5 of the drawing of Herbold, a dumbbell is provided having two parallel rotating discs at the two ends of a handle bar. The discs are heavy weights enclosed within a housing and freely rotatable about the axis of the handle bar. An accessory drive shown in FIG. 4 is used to "spin up" the disc weights within the dumbbell.

Although this gyroscopic dumbbell exerciser is an advance upon simple weighted dumbbells, it is not capable of taking full advantage of the precession effect. In a typical exercising motion, the dumbbell may be grasped by the handle bar, with the arm fully extended, and with the palm of the hand facing upward. Exercise is obtained by flexing the muscles of the arm to lift the dumbbell by an upward swinging motion of the arm which swings the hand and the dumbbell through an upward arc. Since this upward lifting (curl) motion does not change the spin axis of the spinning discs, there is no precession effect produced by this exercising movement and in this common type of exercise the gyroscopic dumbbell behaves like a simple weighted dumbbell.

In the embodiment shown in FIGS. 1 and 2 of Herbold both a cup-shaped rotatable mass 8 and a self-contained motor 4 for rotating the mass are incorporated within a housing 1 which is surrounded by a circular handgrip 2 connected to the housing by three radial spokes 3. The motor 4 closely surrounds the spin axis of the rotatable mass 8, so that any gyroscopic effect of the motor rotor is negligible, reducing the gyroscopic exercise "efficiency" of the device. The handgrip, which has the general shape of a steering wheel, is adapted for two-handed use, and cannot readily be held in one hand.

Other exercise devices utilizing gyroscopic and other effects of a rotating mass are disclosed in the following U.S. Pat. Nos.

| | |
|---|---|
| Newkirk et al. | 1,058,786 |
| Silkebakken et al. | 4,150,580 |
| Kellogg | 850,938 |
| Dean | 3,482,835 |
| Vetter | 3,841,627 |
| Klose | 3,901,503 |

Accordingly, an object of the present invention is to provide an improved gyroscopic type of exercise device.

SUMMARY OF THE INVENTION

As herein described, according to one aspect of the invention there is provided a precessional exercising device, comprising: a housing containing a rotatable cup-shaped mass, said mass having a spin axis about which the mass is dynamically balanced, so that the centroid of mass of said mass lies on said spin axis, said mass having a peripheral lip with a cylindrical inner surface surrounding and coaxial with said spin axis, said housing also having top and bottom surfaces which are substantially perpendicular to said spin axis; bearing means mounting the mass within said housing for rotation about said spin axis; an electric motor for spinning the mass about said spin axis, said motor having a stator core and a stator winding disposed on said core, said stator winding being disposed within the lip of said mass, said motor having a rotor comprising said mass, said rotor including a plurality of permanent magnets disposed on and secured to the cylindrical inner surface of said lip and surrounding the stator winding of said stator, so that when said stator winding is energized to generate a rotating magnetic field which interacts with the magnetic fields of said permanent magnets, said mass is caused to rotate at a speed corresponding to the speed of rotation of the stator magnetic field; and holding means connected to said housing for enabling said housing to be rotated so as to change the direction of said spin axis.

According to another aspect of the invention, there is provided a precessional exercising device, comprising: a housing containing a rotatable cup shaped mass, said mass having a spin axis about which the mass is dynamically balanced so that the centroid of mass of said mass lies on said spin axis, said mass having a peripheral lip with a cylindrical inner surface surrounding and coaxial with said spin axis, a shaft disposed with in said housing on said spin axis; first and second bearings disposed within said housing and spaced apart along said spin axis for rotatably supporting said shaft for rotation about said spin axis, said mass being secured to said shaft at a point between said bearings; an electric motor for spinning the mass about said spin axis, said motor having a stator core and a stator winding disposed on said core, said stator winding being disposed within the lip of said mass, said motor having a rotor comprising said mass, said rotor including a plurality of permanent magnets disposed on and secured to the cylindrical inner surface of said lip and surrounding the stator winding of said stator, so that when said stator winding is energized to generate a rotating magnetic field which interacts with the magnetic fields of said permanent magnets, said mass is caused to rotate at a speed corresponding to the speed of rotation of the stator magnetic field.

According to a further aspect of the invention, there is provided a device for exercising the muscles associated with a limb extremity or other part of the body by resisting precession torque generated by the device, comprising: a housing; bearing means within the housing; a mass within the housing and supported by said bearing means for rotation about a spin axis, said mass being dynamically balanced about said spin axis; means for rotating said mass about the spin axis; a support; connecting means for connecting said housing to said support and for rotatably supporting said housing such that said housing is rotatable relative to said support about (i) a first axis passing through the centroid of mass of said housing and perpendicular to said spin axis, and is also rotatable relative to said support about (ii) a second axis passing through the centroid of mass of said housing and perpendicular to both said spin axis and said first axis; actuator means adapted to be held by or connected to said limb extremity or other part of the body; coupling means for bidirectionally linking said actuator means to said housing, so that (i) angular rotation of said actuator means about two mutually orthogonal axes results in corresponding angular rotation of said housing about said first and second axes respectively, and (ii) any precessional torque generated by said mass about said first and second axes is coupled to said actuator means so as to apply corresponding amounts of torque to said actuator means about respective ones of said mutually orthogonal axes; whereby the limb extremity or other part of the body may be exercised by rotating the actuator means about said mutually orthogonal axes and resisting the resulting torque applied to said actuator means about said mutually orthogonal axes via said coupling means due to the generation of precessional torque by said mass.

According to an additional aspect of the invention, there is provided a device for exercising the muscles associated with a movable part of the body by resisting precession torque generated by the device, comprising: at least one housing; bearing means within said housing; a mass within said housing and supported by said bearing means for rotation about a corresponding spin axis, said mass being dynamically balanced about said spin axis; means for rotating said mass about said spin axis; body portion support means having a movable body part receiving portion; said housing being mounted on said body portion support means; means for detachably securing a movable part of the body to said movable body part receiving portion of said body portion support means; a first support member having body portion support means bearing means supporting said body portion support means for rotation about a first axis perpendicular to said spin axis; and a second support member having first support member bearing means supporting said first support member for rotation about a second axis perpendicular to first axis and said spin axes; whereby a movable part of the body secured to the movable body part receiving portion of the body portion support means may be exercised by rotating the body portion support means about at least one of said first and second axes and resisting the resulting torque applied to said body portion support means about the other of said first and second axes due to the generation of precessional torque by said masses.

According to still another aspect of the invention, there is provided a device for exercising muscles associated with bending and twisting of the upper body by resisting precession torque generated by the device, comprising: a housing; bearing means within the housing; a mass within the housing and supported by said bearing means for rotation about a spin axis, said mass being dynamically balanced about said spin axis; means for rotating said mass about the spin axis; a support having a lower deck with a lower body support surface for supporting the lower part of the body; frame means hinged to said support for rotation of said frame means about a first axis parallel to said lower body support surface; an upper deck having an upper body support surface for supporting the upper part of the body, said upper deck being mounted for rotation on said frame means about a second axis parallel to said upper body support surface and perpendicular to said first axis; means for detachably securing the upper part of the body to said upper body support surface of said upper deck; said housing being mounted to said upper deck so that the spin axis of said mass is perpendicular to the upper body support surface of said upper deck; whereby the upper part of the body, when secured to the upper body support surface of the upper deck with the lower part of the body supported by the lower body support surface of the lower deck, may be exercised by rotating the upper part of the body said first and second axes and and resisting the resulting torque applied to the upper part of the body about said first and second axes due to the generation of precessional torque by said mass.

According to a still further aspect of the invention, there is provided a precessional exercising device, comprising: a spherical housing containing a rotatable cup-shaped mass, said mass having a spin axis about which the mass is dynamically balanced, so that the centroid of mass of said mass lies on said spin axis, said mass having a peripheral lip with a cylindrical inner surface surrounding and coaxial with said spin axis, said housing also having top and bottom surfaces which are substantially perpendicular to said spin axis; bearing means mounting the mass within said housing for rotation about said spin axis; an electric motor for spinning the mass about said spin axis, said motor having a stator core and a stator winding disposed on said core, said stator winding being disposed within the lip of said mass, said motor having a rotor comprising said mass, said rotor including a plurality of permanent magnets disposed on and secured to the cylindrical inner surface of said lip and surrounding the stator winding of said stator, so that when said stator winding is energized to generate a rotating magnetic field which interacts with the magnetic fields of said permanent magnets, said mass is caused to rotate at a speed corresponding to the speed of rotation of the stator magnetic field; and a support with a support surface having a recess for receiving a portion of the surface of said housing so as to prevent rolling of said housing on said support surface, whereby the housing may be grasped to exercise the arm by rotating the housing to rotate the spin axis of said mass, and resisting the resulting torque applied to the hand due to the generation of precessional torque by said mass.

IN THE DRAWING

FIG. 12 is a perspective view of a precessional exercising device for the back, according to a seventh embodiment of the invention; and FIG. 13 is a perspective view of a precessional exercising device for the hands and arms, according to an eighth embodiment of the invention.

GENERAL DESCRIPTION

Figure 1:
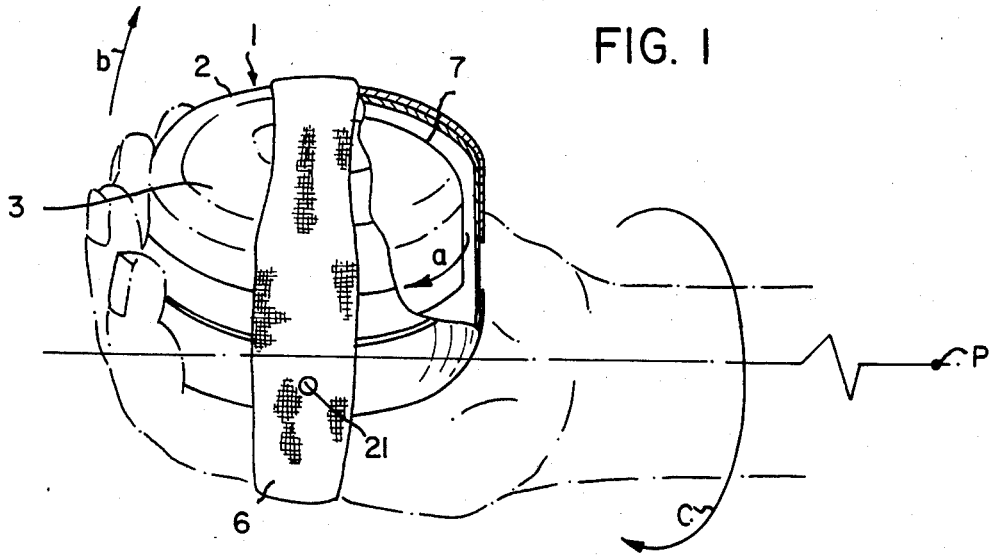
FIG. 1 is a perspective view of a precessional exercising device according to a first embodiment of the invention, suitable for (but not limited to) single hand or single leg use, with portions of the housing broken away to show the inside of the device.

When a mass is made to spin about an axis, it will resist forces acting to change the angular position of the spin axis, so that a torque must be applied to change the direction of the spin axis. Any attempt to rotate the spin axis results in generation of a torque ("precessional torque") about a third axis at right angles to both the spin axis and the axis about which rotation of the spin axis is attempted. The generation of this torque is known as "gyroscopic effect" or "precessional effect"; and the resulting rotation (if not adequately resisted) of the mass about the third axis is known as "precession".

Thus if one then attempts to resist the precessional motion, there is encountered a precessional torque that tends to rotate the mass, along with anything connected to the mass, in the direction of the precession. This precessional torque may be utilized for beneficial exercise of the muscles of the body.

The precession effect of the spinning mass is reciprocal between the two axes which are orthogonal to each other and to the spin axis.

That is, if one rotates the spin axis about a first axis perpendicular to the spin axis, a first torque is required to do so; and the application of this first torque results in generation of a precession torque which rotates the spin axis about a second axis perpendicular to both the spin axis and the first axis. The greater the first torque which is applied, the faster the spin axis rotates about the first axis, and the greater the precession torque generated about the second axis.

Similarly, if one rotates the spin axis about the second axis, a second torque is required to do so; and this application of the second torque results in generation of a precession torque which rotates the spin axis about the first axis. The greater the second torque which is applied, the faster the spin axis rotates about the first axis, and the greater the precession torque generated about the first axis.

Thus the spinning mass effectively acts as a "torque coupler" to couple to the second axis a torque one applies to the first axis, and vice versa.

If one simultaneously applies a torque to the first axis and a resisting torque to the second axis to resist the resulting precession torque about the second axis, the resisting torque about the second axis is coupled back to the first axis to increase the torque required to rotate the spin axis about the first axis.

Thus if one uses a first group of muscles (pronator and supernator muscles, for example) to rotate the spin axis about the first axis, and a second group of muscles (flexor and extensor muscles, for example) to simultaneously resist precession of the spin axis about the second axis, the greater the torque applied by the first group of muscles about the first axis, the greater the torque that must be applied by the second group of muscles about the second axis, and vice versa. The spinning mass couples these torques to each other, so that the first group of muscles works against the second group of muscles, providing an isometric exercise effect, and also enhancing coordination between the two muscle groups.

This isometric exercise effect results in the application of torques to the muscles involved which are due not only to the angular inertia of the spining mass but also to its torque coupling action between the first and second axes. Therefore the torques applied to the first and second groups of muscles can be substantially greater than the precessional torque due to the angular momentum of spinning mass itself.

By providing means for holding a spinning mass in one hand or on one leg, so that the spin axis is perpendicular to the long axis of the limb to be exercised, especially beneficial exercises may be performed against the precessional torque and the torque coupled between the first and second axes by forcibly and arcuately moving the spin axis of the mass in a plane passing through the limb, i.e. by bending the arm at the elbow or wrist, or by bending the leg at the knee or ankle. Such exercises cause a precessional torque to be generated which tends to rotate the limb about the long axis thereof.

Certain muscles of the limbs may be exercised by resisting this rotational or twisting tendency. This results in particular benefits to the muscles or muscle groups used to rotate the limb, and exercises muscles and muscle groups which it is not possible to effectively exercise by using ordinary weights.

In the design of the exercise device of the present invention, the gyroscopic effect "efficiency" is maximized by integrating the rotating mass with the motor, so that the rotating mass serves as the rotor of the motor. The rotor of the motor is positioned away from the spin axis so as to increase the moment of inertia thereof, with the motor stator being positioned relatively close to the spin axis, i.e. within the rotor.

In the first embodiment (FIGS. 1 to 3) the rotor is supported by the motor shaft in cantilever fashion, i.e. with both shaft support bearings being disposed on one side of the point of attachment of the rotor to the shaft.

In the second embodiment (FIGS. 4 and 5) the stress on the bearings is reduced, the "feel" of the device is improved and undesirable static imbalance is eliminated, by securing the rotor to the shaft at a point between the bearings, such that the centroid of mass of the rotor lies in the center plane (perpendicular to the spin axis) of the device housing.

In both the first and second embodiments, the upper and lower portions of the housing are made dissimilar, by utilizing different materials, different colors, or in any other way which makes them readily visually differentiable. Thus the user of the device can tell when he is reversing the spin direction of the rotating mass relative to himself, so that he will know which direction the housing will tend to "twist" in when he performs exercises.

A grip means is configured to maintain the spin axis at substantially a right angle to an axis extended lengthwise of the limb being exercised. In the case of a hand-held device, the effective moment arm between the centroid of the mass and the palm of the hand is kept small by shaping the housing so as to have oppositely disposed holding surfaces perpendicular to the spin axis, and shaping the rotating mass (which also serves as the motor rotor) so as to have a major portion which extends generally parallel to the holding surfaces of the housing.

In the aforementioned hand-held device the grip means comprises a strap and the adjacent holding surface of the housing. The strap extends adjacent both of the holding surfaces and is preferably made of a resilient material, so that the hand or foot can be retained in position between the strap and the adjacent holding surface. The housing is grasped in the hand with the selected holding surface resting against the palm of the hand, and the spin axis oriented at substantially a right angle to the palm of the hand, with the centroid of the mass being spaced a relatively short distance from the palm.

Another aspect of the present invention, as exemplified by the third and fourth embodiments thereof (FIGS. 6 and 7 of the drawing), involves the provision of a remote grip means and interconnecting linkage which transmits angular movements of the grip means to the spinning mass and couples precessional torques back to the grip means. In these embodiments the grip means and the spinning mass are on opposite sides of a fulcrum.

Exercise is obtained by grasping the grip means, rotating it about one or both of two axes to change the angular position of the spin axis of the rotating mass within the housing, and using the muscles to control the precessional torque produced by the spinning mass and coupled back to the grip means.

The fourth embodiment (FIG. 7) includes an interlock for limiting the range of angular movement of the grip means so as to avoid possible injury to a weak or inexperienced user of the device, as well as locking mechanisms for restricting rotational movement of the handle to a desired axis or axes.

In a modified form of the fourth embodiment (FIG. 7A) the grip means and spinning mass are on the same side of the fulcrum.

The fifth embodiment (FIG. 10) is a variation of the linkage arrangement of the third and fourth embodiments, and employs a foot plate mounted for use in a supine position.

The sixth embodiment (FIG. 11) is a modification of the fifth embodiment, and employs a foot plate mounted for use in a standing or sitting position.

In a modified form of the sixth embodiment (FIG. 11A), a pair of rotating masses is mounted on lateral extensions disposed on opposite sides of the foot plate.

The seventh embodiment (FIG. 12) is a cot-like structure having an upper section hinged to the lower section at the waist position of the user, to permit "sit-up" movements of the upper body. The upper section (which supports the upper body of the user) is also mounted for rotational movement about an axis perpendicular to the hinge, for permitting twisting movement of the upper body about the waist, and is counterbalanced. In this embodiment the housing containing the rotating mass is secured to the lower surface of the upper section of the cot-like structure, with the spin axis vertical when the upper section is horizontal.

The exercise device of the eighth embodiment (FIG. 13) employs two spaced spherical housings, each containing a rotating mass. Each housing rests in a crater on a support board. Preferably, the spin axis of the rotating mass within each housing is initially vertical or initially horizontal, depending upon the mode of exercise desired. Exercise is performed by grasping one spherical housing in each hand, and rotatably manipulating the housing. Since the housings are not lifted against the force of gravity, there is no risk of dropping them, and therefore this device is especially suitable for use by the disabled.

DETAILED DESCRIPTION OF THE PREFERRED EMBODIMENTS

Figure 2:
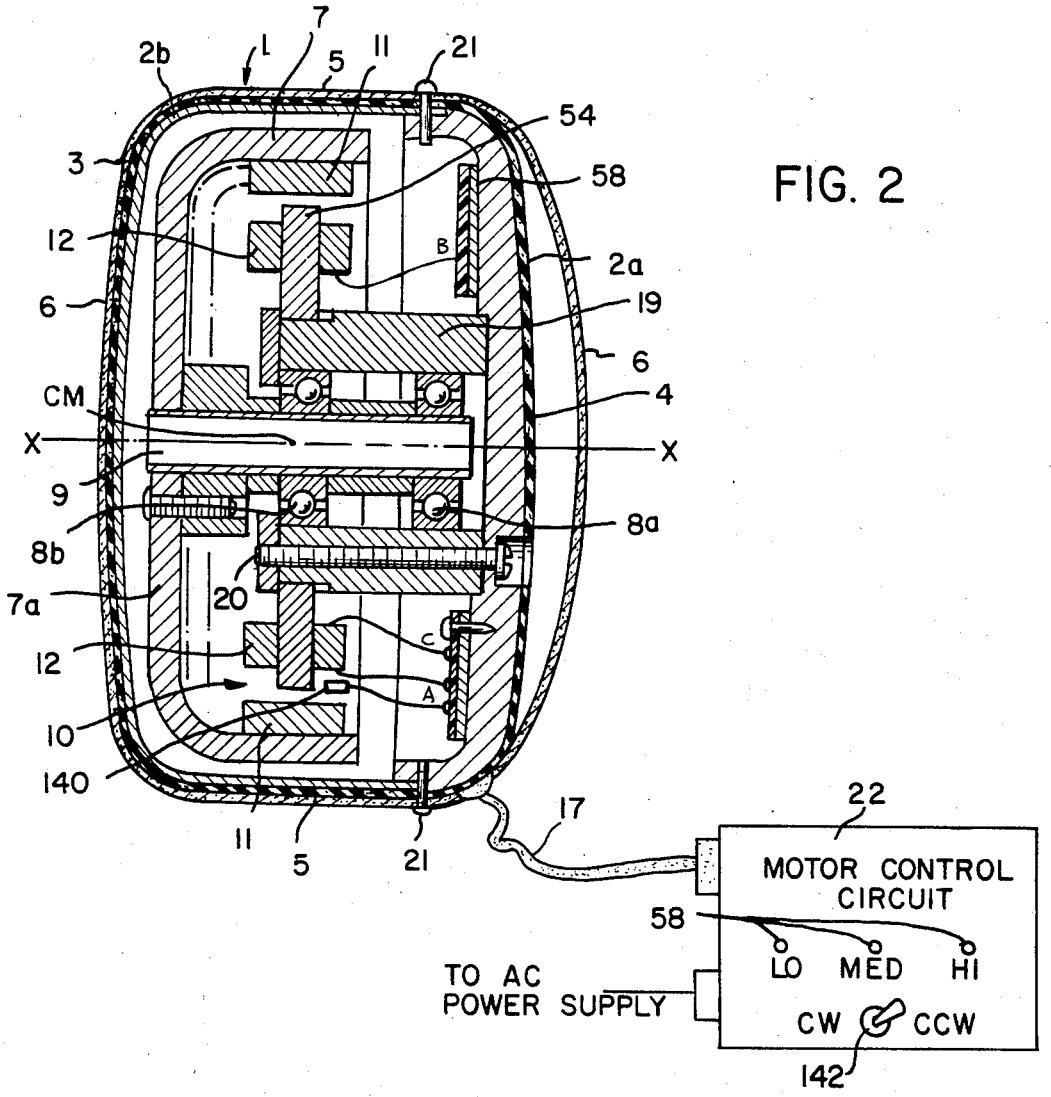
FIG. 2 is a side cross-sectional view of the device of FIG. 1.
Figure 3A:
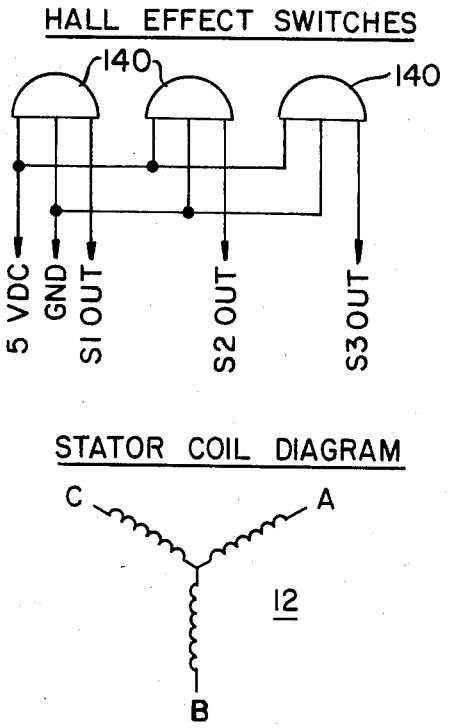
FIG. 3A shows the electrical configuration of the Hall effect sensor switches and the stator of the motor employed in the device of FIG. 1.

The precessional exercising device 1 shown in FIGS. 1 to 3 is suitable for (but not limited to) exercise of the rotator muscles of the wrist and forearm and is configured to fit within the palm of the hand of the user.

The device 1 generally comprises a two-piece housing 2 having an upper cast base portion 2*a* and a different color lower shaped sheet metal or plastic portion 2*b*. The upper and lower portions 2*a* and 2*b* are secured together by screws or other suitable means (not shown).

The housing 2 is sized and shaped so that it can be readily and securely held in a hand of the user, oriented so that the spin axis X—X is perpendicular to the palm. As shown in FIGS. 1 and 2, the housing 2 may typically be substantially cylindrical in shape, with top and bottom surfaces 3 and 4 which are substantially flat or provided with a slight curvature, as best seen in FIG. 2. The top and bottom surfaces 3 and 4 are generally perpendicular to the spin axis X—X and generally parallel to the major portion 7*a* of the cup-shaped rotatable mass 7, which mass also constitutes the rotor of the motor 10 within the housing 2.

Figure 4:
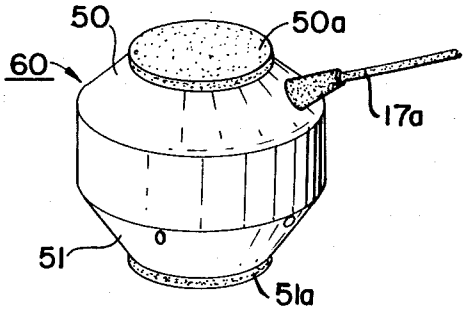
FIG. 4 is a perspective view of a precessional exercising device according to a second embodiment of the invention, corresponding to a modification of the first embodiment.
Figure 5:
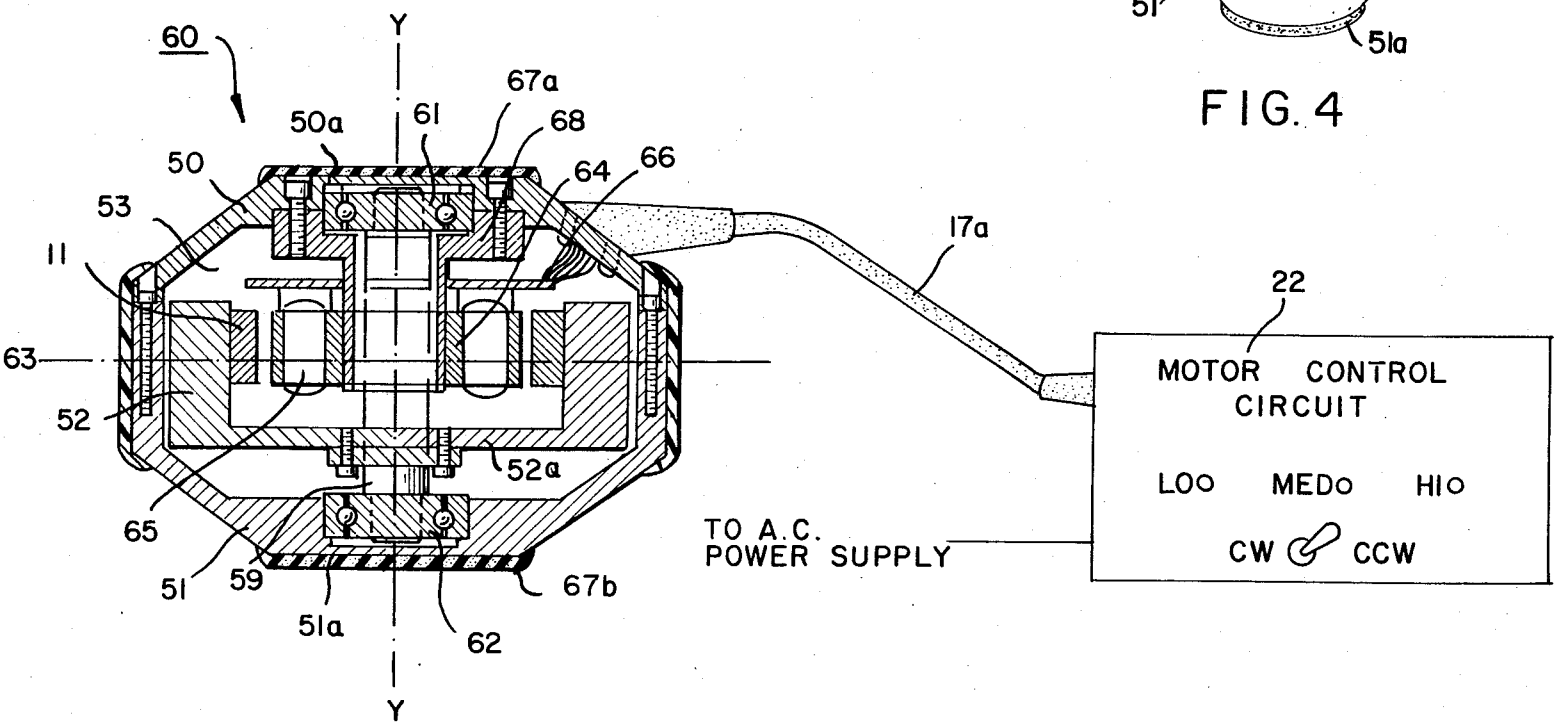
FIG. 5 is a side cross-sectional view of the device of FIG. 4.

Alternatively, the housing 2 may be provided with frusto-conical dissimilar (in color, material, texture, etc.) top and bottom surfaces 50 and 51, as shown in FIGS. 4 and 5. The central flat portions 50*a* and 51*a* of the top and bottom surfaces 50 and 51 are generally parallel to each other and perpendicular to the spin axis Y—Y; and generally parallel to the major portion 52*a* of the cup-shaped rotatable mass 52, which mass also constitutes the rotor of the motor 53 within the housing 2.

Preferably top and bottom surfaces 3 and 4 of the device shown in FIGS. 1 and 2, and top and bottom surfaces 50*a* and 51*a* of the device shown in FIGS. 4 and 5, are covered with a thick (about 0.067 inch) layer of resilient cushioning material such as synthetic foam rubber. This material acts as a shock absorber and helps to improve the grip on the device.

An elastic strap 6 (not shown in FIGS. 4 and 5) is fitted around the housing so as to traverse the upper and lower portions 2*a* and 2*b*, and is secured to the housing by any suitable means such as rivets 21. Strap 6 may also be an adjustable inelastic strap, as long as it fits snugly around the back of the hand. Alternative strap means may be used for attaching the device 1 to a foot, ankle, leg or other part of the body.

As previously mentioned, the cup-shaped or bell-shaped rotatable mass 7 which forms the rotor of a motor 10 for rotating the mass, is located within the housing. A rotatable shaft 9 is aligned with the spin axis X—X, and one end of the shaft 9 is attached to the center (axis of symmetry) of the rotatable mass 7.

Shaft 9 is mounted upon a pair of spaced apart ball bearings 8*a* and 8*b* to permit spinning of the mass 7 and shaft 9 about the spin axis X—X, with minimal friction. The bearings 8*a* and 8*b* are mounted in cylindrical bearing support 19, which support is attached to housing 2 by a plurality of screws, one of which is identified by the numeral 20.

Attached to the cylindrical inside surface of the outer edge of mass 7 are eight (ceramic or other suitable type) permanent magnets 11. Each permanent magnet is oriented to provide a magnetic field which can interact with a magnetic field generated by the three phase Y-connected stator winding 12, which is wound on the stator core 54, to cause rotation of the rotatable mass 7. The stator winding 12 may preferably be wound so as to provide a four pole motor. If desired, the stator winding 12 may alternatively be delta-connected.

The stator core 54 comprises a magnetically permeable material and is secured to the bearing support 19.

Three stationary Hall effect sensor switches 140 are disposed 120 degrees apart from each other, between the stator winding 12 and the magnets 11, to detect the position of the rotating mass 7 and generate corresponding control signals S1, S2 and S3 (see FIG. 3A) for commutating the stator winding 12.

The three terminals A, B and C of the stator winding 12 and the five leads of the Hall effect sensor switches 140 are connected to an annular circuit board 58, which electrically connects said leads to corresponding conductors of an eight conductor cable 17.

A motor control circuit 22 has (i) power supply and switch signal input terminals connected to corresponding terminals of the Hall effect sensor switches 140, and (ii) output terminals connected to corresponding conductors A, B and C of the three-phase stator winding 12, via the cable 17 and circuit board 58.

Figure 3B:
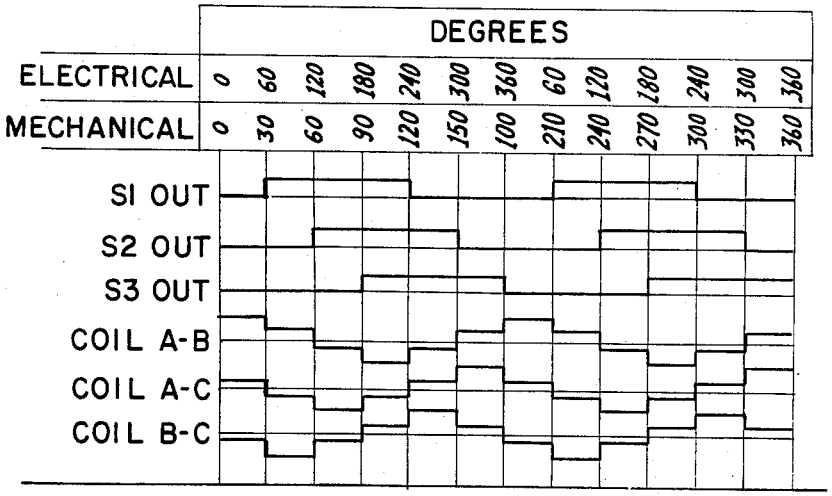
FIG. 3B is a timing diagram of the voltages generated by the Hall effect sensor switches and the voltages supplied to drive the stator shown in FIG. 3A.

The motor control circuit 22 provides three phase drive signals to the stator winding 12 in response to the switching signals from the Hall effect sensor switches 140, for energizing the stator winding 12 so as to generate a magnetic field for maintaining rotation of the mass 7, in a manner well known in the electric motor art. The basic waveforms and timing of these drive signals in terms of both electrical phase and mechanical (rotating mass position) phase, is shown in FIG. 3B.

The motor control circuit 22 energizes the stator winding 12 to cause the mass 7 to rotate (i) at a speed determined by the settings of the speed control pushbuttons 58, and (ii) in a direction determined by the setting of the clockwise/counter-clockwise toggle switch 142.

The principle of operation of the motor 10 is similar to that employed in the operation of the Clifton JDBH-3250 series of "Brushless DC Spindle Motor"—and particularly the Clifton JDB-3500-N-00 "Hall Effect Brushless D.C. Motor" sold by Clifton Precision, a division of Litton Systems, Inc., having its address at Marple at Broadway, Clifton Heights, Pa., 19018. This motor has a motor drive circuit therein which is entirely suitable for use as the motor control circuit 22.

Such motor control arrangements are well known in the art, and do not comprise any part of the present invention.

The mass 7, including the magnets 11 attached thereon, is statically and dynamically balanced about the spin axis X—X, in order to prevent wobbling or vibration when the mass 7 is spun at a high speed, which may typically be on the order of 5,000 to 10,000 rpm.

The mass 7 is preferably made of a relatively dense metal or metal alloy, and must be strong enough to withstand the forces of centripetal acceleration when the mass 7 is spinning rapidly. Mass 7 preferably has a significant portion of its mass distributed near its outer perimeter (i.e. adjacent the magnets 11), so that the moment of inertia of the mass 7 about the spin axis X—X can be maximized for a given weight of the mass.

Since the moment of inertia of a portion of a mass about an axis is proportional to the square of its distance from the axis, it is evident that the moment of inertia may be maximized by distributing a large portion of the mass 7 as far away from the spin axis X—X as possible. It has been found that the cup or bell shape for mass 7 is especially advantageous in this regard. In the preferred embodiment for use by a typical adult, mass 7 weighs approximately 1 pound, and the entire device 1 weighs approximately 2 pounds.

The cup or bell shape of the mass 7 also provides improved reliability by retaining the magnets 11 within the interior thereof, so that the lip of the mass 7 supports the magnets 11 against the centrifugal force caused by rotation of the mass 7.

The spin axis X—X is preferably perpendicular to both the upper surface 3 and the lower surface 4 of the housing 2. When the device 1 is used by being held in the hand, the housing lower surface 4 is parallel to the palm of the hand, and the spin axis X—X, is approximately perpendicular to the palm and to an axis extended lengthwise of the forearm when the palm is extended, as seen in FIG. 1.

The housing 2 is configured in size and shape so as to be easily grasped in one hand, with the fingers having a good grip upon the device 1. The upper and lower surfaces 3 and 4 are approximately the size of the palm, or slightly smaller, of the person using the device. As previously mentioned, housing 2 and strap 6 cooperate to comprise grip means for maintaining the spin axis X—X at approximately a right angle to the palm of the hand and to the long axis of the forearm.

An exercising movement used with the device 1 is illustrated in FIG. 1, where the arcuate arrow designated "b" represents an arcuate exercising movement in an upward direction about the pivot point "P". The pivot point "P" may be the wrist joint, the elbow joint or the shoulder joint, or may be some other pivot point during other types of arcuate exercising movements. Many other arcuate exercising movements are possible in accordance with the present invention.

Exercising movements in accordance with the present invention must bring the device 1 through a curved or rotational path. In contrast, a straight or linear shifting of device 1 which fails to rotate the spin axis, X—X creates no precession effect and produces none of the advantages of the invention.

In order to better understand the full significance of the present invention, the arcuate exercising movement mentioned above will be discussed in some detail, with specific reference to the device 1 of FIGS. 1 to 3 and the exemplary exercising movement shown in FIG. 1.

As seen in FIG. 1, the device 1 is grasped in the hand with strap 6 looped around the back of the hand so that housing 2 is firmly held with the bottom surface 4 flush against the palm. When the arm is swung in an upward arcuate ("curl") motion about the pivot point "P", the device 1 is carried through an arcuate path represented by the arrow "b" in FIG. 1. This arcuate movement produces like movement of the spin axis of mass 7.

Since mass 7 within device 1 is spinning rapidly in the direction shown by the arrow "a", a precessional rotation is generated in device 1, which is along the axis perpendicular to both the spin axis and to the pivot axis of the arcuate movement. This axis, called the precession axis, is an axis extending along the length of the arm.

If the precessional motion is resisted by the person, by forcibly preventing the device 1 from precessing during the arcuate exercising movement, a strong precessional torque is generated which tends to rotate the hand in the direction shown by the arcuate arrow "c" in FIG. 1.

The strength of the precessional torque depends on several factors. Of primary importance is the spin velocity and moment of inertia of the mass 7; the higher these values are, the greater the precessional torque which is encountered. Also of great importance in determining the amount of precessional torque is the degree to which the precession is successfully resisted and controlled during the arcuate exercising movement.

If a weak person using the device 1 swings it arcuately as shown in FIG. 1, but does not resist the precession which rotates his hand and forearm in the direction "c", the muscles do not encounter a very significant precessional torque because the arm may simply rotate with the precessing device. If, however, a strong person swings the device 1 through the same arcuate path "b", and successfully controls the device 1 by preventing any precession of the device 1, a stronger precessional torque in the direction "c" is encountered.

The more one resists the precession, the greater is the counter-resistive precessional torque. The precessional exercising device pits the muscles of the person against the angular momentum of the spinning mass, and not against a constant gravitational force. In effect, the precessional exercising device 1 produces a resistive force which is generally proportional to the degree of control a person is able to exert on the device during arcuate exercising movements.

The resistive force of the precessional exercising device 1 is an angular force or torque. In order to successfully resist the precessional torque, those muscle groups associated with twisting motions along the long axis of the limb are especially strained and exercised. The resistive force of this device is therefore beneficial for simultaneously developing the strength and coordination of the rotator muscle groups.

Additional exercising benefits are also produced by the above described method for the flexor and extensor muscle groups. By attempting to control and prevent precession of the device 1, opposing pairs of muscles of the arm and shoulder are simultaneously flexed.

Because the precessional torque is not a constant force, like gravity, there is a tendency for the hand and arm muscles to become unbalanced during arcuate exercising movements. To control this unbalancing tendency, the person is forced to tighten opposing sets of muscles in the hand and arm. The muscles, acting in opposition, can make the feeling of resistive force much greater than the actual precessional torque generated by the spinning mass 7.

For a strong person, such as a professional athlete, who is capable of swinging the device 1 through exercising movements with nearly total control, the feeling of weight upon the muscles can be very great indeed. Accordingly, a vigorous exercise of the flexor, extensor and rotator muscles is achieved.

Thus, during exercising movements with the device 1, fairly strong forces and torques are transmitted between the device 1 and the hand grasping it. In order to control these forces and torques, the grip means, including housing 2 and strap 6, is specially configured to be grasped by the hand while maintaining the spin axis X—X at a right angle to the palm of the hand.

The centroid of mass 7, shown in FIG. 2 as the point "CM", is at a relatively short distance from the bottom surface 4. This short distance between the centroid "CM" and the bottom surface 4 (corresponding to the distance between the centroid and the palm of the hand) represents the effective moment arm between mass 7 and the hand, for angular forces between them. If this moment arm were relatively large, for example larger than about three inches (corresponding to the long dimension of the palm of the hand of an average adult), any tendencies of mass 7 to swing or twist relative to the hand would be greatly magnified through the moment arm, and could overwhelm the user's grip upon the device 1.

In order to prevent potential injury to the user, and to ensure that a solid grip upon the housing 2 can be maintained, it is preferred that the effective moment arm be less than approximately three inches, for a device suitable for use by an average adult.

The method and apparatus described above is particularly beneficial in outer space, where ordinary dumbbells and dead weights are useless for exercising purposes. Since the precession effect of the present invention is produced solely as an interaction between a person and a spinning mass, independent of the Earth's gravity, it is well adapted for exercising in gravity free environments.

The device 60 shown in FIGS. 4 and 5 has a construction generally similar to that of FIG. 1, except that (i) the upper and lower surfaces 50 and 51 are of frustoconical shape, as previously mentioned, and (ii) the rotatable mass 52 is mounted on a portion of the shaft 59 disposed between the ball bearings 61 and 62, at a position such that the centroid CM of the mass 52 lies in the center plane of symmetry 63 of the device 60.

In the device 60, the stator core 64 has a construction similar to that of the stator core 54 of the device 1, and the stator winding sections designated generally by the numeral 65 are similar to the stator winding sections 12*a* through 12*h* of the device 1. The cable 17*a* is similar to the cable 17 connected to the device 1, and the circuit board 66 is similar to the circuit board 58 of the device 1.

The frustoconical shape of the device 60 makes it easier to grip, with the upper flat surface 50*a* or the lower flat surface 51*a* against the palm of the hand. To further facilitate the grip and to provide shock absorption, the flat surfaces 50*a* and 51*a* are covered with foam rubber pads 67*a* and 67*b* respectively, which pads are about 0.017 inch thick.

The distance between the centroid CM of the mass 51 and each of the surfaces 50*a* and 51*a* is less than three inches, for the reason previously discussed with reference to the device 1.

The upper ball bearing 61 is supported by the bearing block 68, which block also supports the stator core 64. The lower ball bearing 62 is supported by the lower housing part 51.

The positioning of the mass 52 so that it is secured to the shaft 59 at a position between the bearings 61 and 62 reduces the side thrust on these bearings as compared with the cantilevered mounting of the mass 7 in the device 1. This positioning of the mass 52 also allows the device 60 to be designed so that the centroid CM of said mass lies on the center plane of symmetry 63 of the device 60, thus providing improved "feel" and comfort of use of the device 60.

Figure 6:
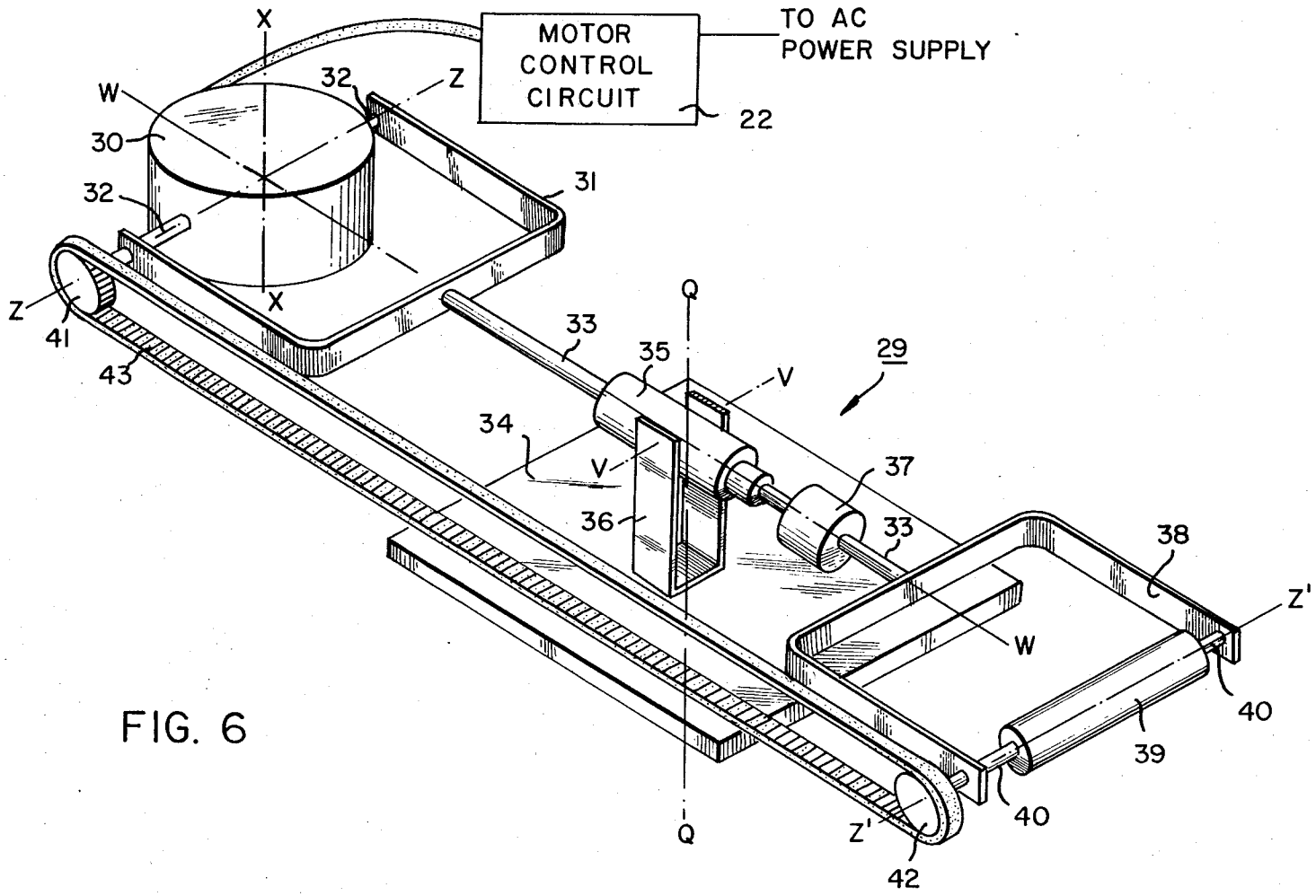
FIG. 6 is a perspective view of a precessional exercising device according to a third embodiment of the invention.

A third embodiment of the invention is illustrated in FIG. 6, which embodiment is particularly suitable for providing physical therapy to partially incapacitated persons and persons confined to bed.

Use of the device 29 of FIG. 6 is especially advantageous for developing muscles associated with the wrist and forearm.

Device 29 has a handle 39 coupled to a housing 30, both the handle and housing being supported upon a stationary base 34.

Housing 30 contains components identical to those of the device 1 shown in FIGS. 1 to 3, including a spinning mass and means for rapidly spinning the mass about the spin axis X—X. Housing 30 is pivotally mounted on the arms of housing supporting fork 31 by a pair of support axles 32. The axis Z—Z passing through support axles 32 also passes through the centroid, "CH", of housing 30, and is perpendicular to the spin axis X—X of the spinning mass within housing 30; which spin axis also passes through the centroid CH. Housing 30 is therefore balanced about the axis Z—Z of support axles 32, and has no tendency to rotate about that axis unless an external force is applied to the housing, e.g. via axles 32.

The housing supporting fork 31 which supports axles 32 is in turn supported by being attached, at the middle of its center leg, to a rod 33. Rod 33 is pivotally connected at the pivot axis V—V of bushing 35 to a bushing supporting flange 36. Bushing supporting flange 36 is rotatably mounted on the base 34 for pivoting about the vertical axis Q—Q.

The rod 33 extends through bushing 35 beyond pivot axis V—V and is attached, at the end remote from the fork 31, to a handle supporting fork 38. Handle supporting fork 38 has at its open end a handle 39 which is rotatably mounted within the arms of fork 38 by handle axles 40.

Pivot axis V—V is preferably located at a position along bushing 35 such that rod 33 is approximately horizontal when the spin axis X—X is vertical and the device 29 is not in use.

Also on the handle side of rod 33 is a balance weight 37 which may be shifted along rod 33 in order to obtain a static balance between the two sides of the pivot axis V—V. Once this static balance is obtained, balance weight 37 can be locked in place (by a thumb screw or other suitable means, not shown) so that static balance is maintained during exercising movements of the device 29.

It is desirable to maintain a static balance about the pivot axis V—V so that the housing 30 does not tend to drop downward under the influence of gravity.

Attached to support axles 32, at one side of housing supporting fork 31, is a first toothed wheel 41 which is rotatable about the first axis Z—Z in unison with support axles 32 and housing 30. Similarly, a second toothed wheel 42, attached to handle axles 40, is rotatable about the Z'—Z' axis in unison with handle axles 40 and handle 39.

The first and second toothed wheels 41, 42 are interconnected by a drive belt 43 which couples any rotation of handle 39 about the axis Z'—Z' to cause rotation of housing 30 about the axis Z—Z, and vice versa. Thus toothed wheels 41, 42 and drive belt 43 comprise a coupling means for bidirectional transmission of rotational motion between housing 30 and handle 39 about the parallel axes Z—Z and Z'—Z'.

Similarly, housing 30 and handle 39 are coupled together via rod 33, housing support fork 31, support axles 32, handle supporting fork 38 and handle axles 40, for mutual angular motion about a second axis W—W, which extends lengthwise of rod 33. The second axis W—W passes through the centroid CH of housing 30, and is perpendicular to both the spin axis X—X and the first axis Z—Z. Any rotation of housing 30 about the second axis W—W through a given angle rotates handle 39 through the same angle, and vice versa.

Thus housing 30 and handle 39 are bidirectionally linked for rotational motion about both the first axes (Z—Z and Z'—Z') and second axis (W—W) perpendicular to the spin axis X—X.

It has been found to be unnecessary to provide any separate means for statically balancing housing 30 about axis W—W, because housing 30 is for all practical purposes already balanced about the axis of rod 33 in view of the negligible weight of toothed wheels 41, 42, and drive belt 43 as compared to the combined weight of housing 30, handle 39, and forks 31 and 38.

Although, in the preferred embodiment of FIG. 6, any rotation about the parallel axes Z—Z and Z'—Z' is rotationally coupled in a 1 to 1 ratio, it is also possible to vary the angular coupling ratio by using different sizes for toothed wheel 41 and toothed wheel 42, in order to obtain a magnified or diminished precession force at handle 39.

To use device 29, handle 39 is grasped in the hand, with the center of the palm contacting the surface of handle 39 and with the arm extending away from handle 39 and roughly parallel to rod 33. An exercising movement rotating handle 39 about the axis Z'—Z' axis is made, thus forcing an equal rotation of the housing 30 about the axis Z—Z.

With the mass within the housing 30 spinning rapidly, a precession effect is generated tending to rotate housing 30 and rod 33. The precession axis W—W is perpendicular to both the spin axis X—X and the axis Z—Z of the arcuate exercising movement. By forcibly preventing handle 39 from twisting about this precession axis W—W and by controlling any unbalancing tendencies, the muscles may be rigorously exercised.

The pivot V—V permits the hcight of handle 39 relative to the base 34 to be shifted upward or downward, to accommodate the position of the user's arm, whether he is sitting or lying down, so that the device 29 can be conveniently and comfortably used.

Since the rotational motion about the axis Z—Z is a rotational motion about the centroid CH of the housing 30, the effective moment arm between the torque applied by the hand and the housing 30 is the distance between the palm of the hand, while grasping handle 39, and the axis of rotation Z'—Z'— i.e. the diamter of the handle 39. By maintaining this effective moment arm smaller than approximately the long dimension of the palm of the hand, the muscles may be exercised with a minimal risk of injury. In addition, any tendency of the handle 39 to slip out of the user's grip during exercising movements is reduced. Preferably, the diameter of the handle 39 is on the order of 1 to 1.5 inches.

Similarly, the effective moment arm for rotational movement about the second axis W—W is comparably small to that about the first axis Z'—Z', since the axis W—W, passing through the centroid CH of housing 30, also passes through the center of handle 39, and the center of handle 39 is a relatively short distance from the center of the palm of the hand.

Although handle 39 is intended for grasping by a hand, it may be replaced by a harness or other means for coupling the foot or ankle to the angular motions of housing 30.

Use of device 29 can be especially beneficial to persons who wish to develop the muscles associated with any limb extremity, but who may not be able to use the device 1 of FIGS. 1 to 3, whether because of illness, injury, or incapacity.

Figure 7:
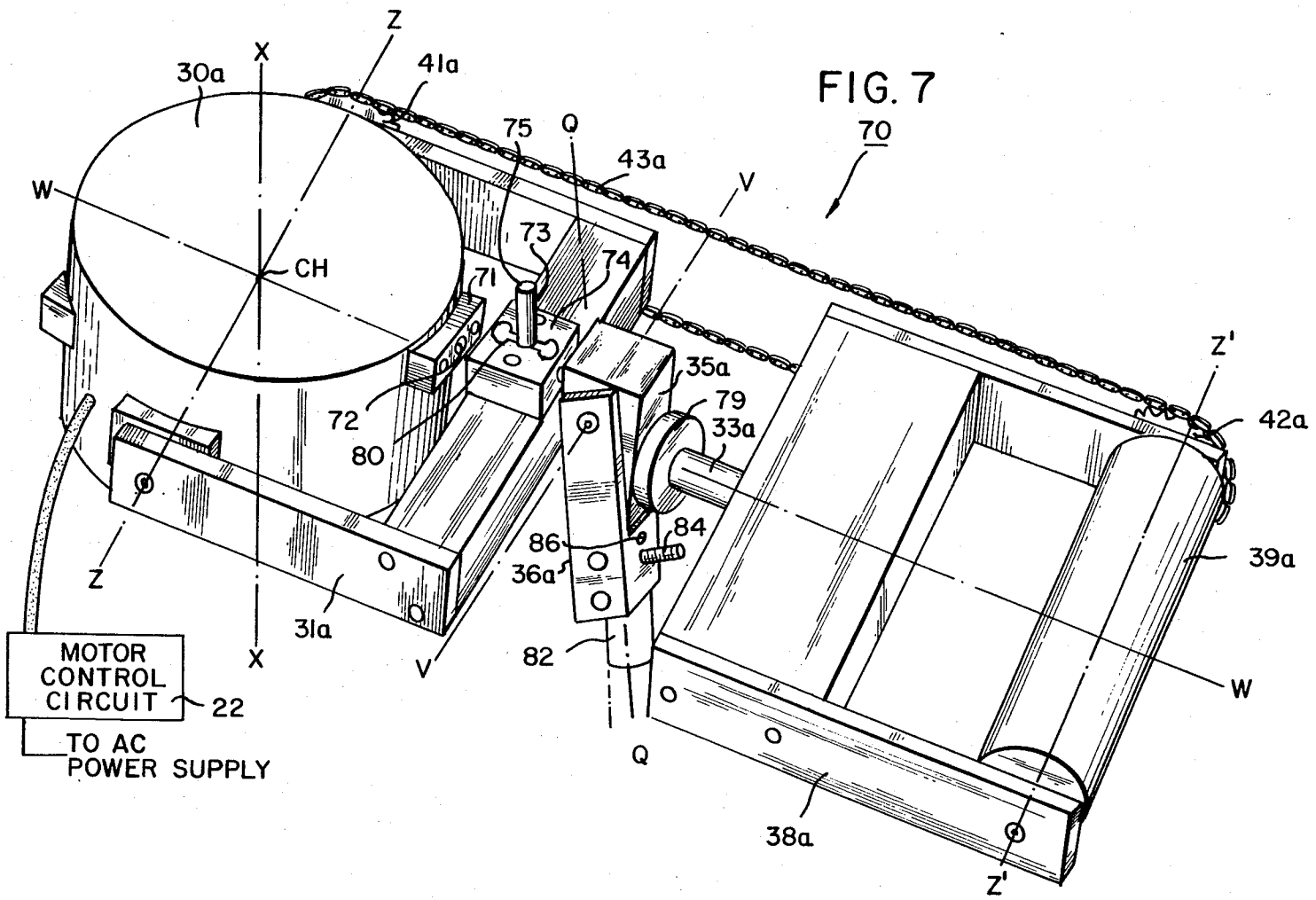
FIG. 7 is a perspective view of a precessional exercising device according to a fourth embodiment of the invention, corresponding to a modification of the third embodiment.

FIG. 7 shows a device 70 which is constructed and which operates in a manner similar to the device 29 of FIG. 6. In FIG. 7, those parts which function in a manner similar (but not necessarily identical) to corresponding parts of the device 29 are given the same numerals as such corresponding parts, followed by the letter "a".

Figure 8:
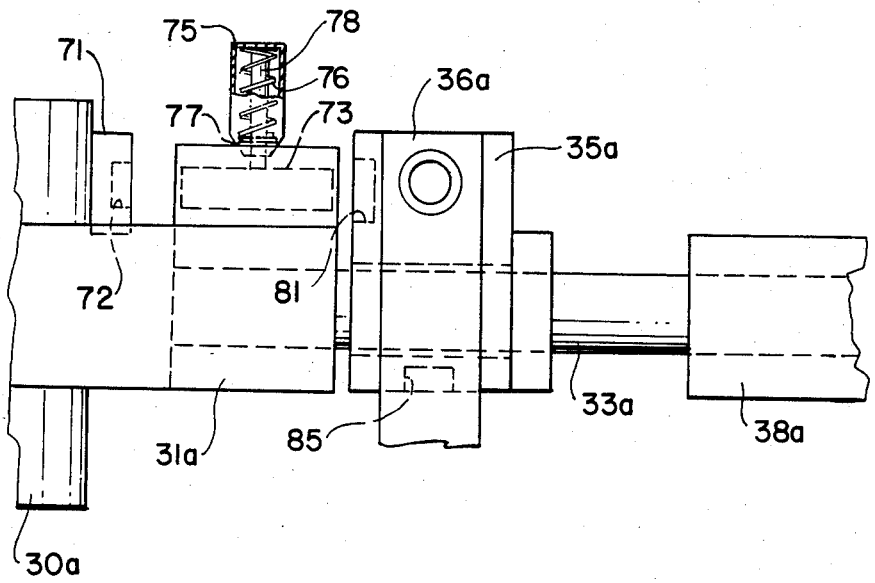
FIG. 8 is a partially cutaway perspective view showing the combined locking and angle-limiting mechanism of the device of FIG. 7.

In the device 70, the housing **30*a* has an internal structure identical to that of the device 60 shown in FIGS. 4 and 5, with the rotating mass within the housing having a spin axis X—X On the external cylindrical surface of the housing is mounted a locking receptable block 71 having a locking hole 72 for receiving one end of a T-shaped pin 73 (best shown in FIG. 8). The T-shaped pin 73 is mounted to a pin support block 74 which is secured to the center leg of the housing supporting fork 31*a***.

The pin support block 74 has a longitudinal hole therein parallel with the axis W—W, for receiving the sliding portion of the T-shaped pin 73. The block 74 also has a longitudinally extending slot 80 for permitting sliding movement of the vertical stem 78 of the T-shaped pin 73. The slot 80 has an intermediate portion with a width less than the diameter of the cap 75 of the pin 73, and circular end portions with a diameter greater than that of the cap 75.

As seen in FIG. 8, the cap 75 of the T-shaped pin 73 is hollow and contains a tension spring 76. The upper end of the spring 76 is secured to the inner surface of the top of the cap, and the lower end of the spring is secured to a split ring 77 secured in a peripheral groove in the vertically extending leg 78 of the T-shaped pin 73, so that the cap 75 is urged downward toward the block 74.

The rod **33*a* is secured at one end to the handle supporting fork 38*a*, and at the other end to the housing supporting fork 31*a*. The rod 33*a* extends through and is journalled in the bushing 35*a*. A collar 79 is secured to the rod 33*a* and cooperates with the bushing 35*a* to prevent leftward sliding of the rod 33*a* within said bushing. Rightward sliding of the rod 33*a* within the bushing 35*a* is prevented by the adjacent surface of the center leg of the housing supporting fork 31*a***.

When the T-shaped pin 73 is in its neutral position as shown in FIG. 7, the cap 75 is held up by engagement with the upper surface of the block 74, and is slidably movable between the circular end portions of the slot 80.

When the T-shaped pin 73 is slid to the circular end portion of the slot 80 adjacent the housing **30*a*, the adjacent end of pin 73 engages the hole 72 in block 71, thus preventing rotation of the housing 30*a* about the axis Z—Z; and the cap 75 drops into said circular end portion of the slot 80 to retain the pin 73** in this locked position.

With the housing **30*a* so locked, the coupling between the housing 30*a* and handle 39*a* via the sprocket wheels 41*a* and 42*a* and the chain 43*a* prevents rotation of the handle 39*a* about the axis Z'—Z'. However, the handle 39*a* remains free to rotate about the axis W—W, so that the device 70** is restricted to this mode of exercise alone.

When the cap 75 is pulled up and then moved to the other end of the slot 80, i.e. the end adjacent the bushing **35*a*, the cap drops into the circular hole at the corresponding end of the slot, locking the pin 73 in the corresponding position, with the adjacent end of the pin 73 extending into the hole 81 in the bushing 35*a*, as seen in FIG. 8**.

Since the hole 81 in the bushing **35*a* is significantly larger in diameter than the adjacent end of the T-shaped pin 73, the fork 31*a* and housing 30*a* connected thereto is permitted to rotate about the axis W—W through an angular range limited by abutment of the adjacent end of the pin 73 with the cylindrical wall of the hole 81. Preferably, the hole 81 and adjacent end of the pin 73 are dimensioned and aligned so that when the cap 75 is in the end of the slot 80 adjacent the bushing 35*a*, the handle 39*a* can be rotated about the axis W—W through an angle on the order to 10 to 20 degrees. This restricted range of motion minimizes any risk of injury to a weak or inexperienced user of the device 70, which might otherwise be caused by unexpected large angular rotations of the handle 39*a*** about tne axis W—W.

The bushing **35*a* is rotatably mounted to bushing support 36*a*, for rotational movement about pivot axis V—V. Bushing support 36*a* is secured to a rotatable vertical rod 82. An L-shaped pin 83 has a cap 84 which has a construction similar to the cap 75 of the T-shaped pin 73**.

Figure 9:
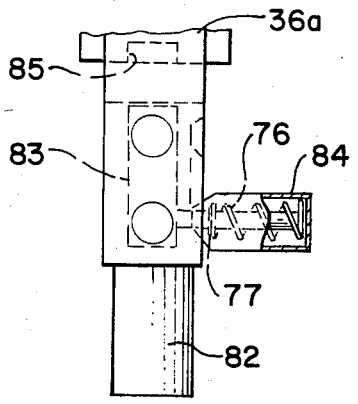
FIG. 9 is a side cross-sectional view showing the other locking mechanism of the device of FIG. 7.

The bushing **35*a* has a vertically extending bottom hole 85 (FIG. 9) for receiving the adjacent end of the L-shaped pin 83 when the cap 84 is slid up so that the cap 84 is drawn into the enlarged circular upper end of the slot 86 in the bushing support 36***a*. In this position, the bushing 35*a* is locked to the bushing support 36*a* so that the rod 33*a* is kept horizontal, for those users and exercises wherein it is desired to preclude shifting of the rod 33*a* about the axis V—V by the user.

When the cap 84 is moved down so that the pin 83 does not extend into the hole 85 of the bushing 35*a*, the angular range of movement of the rod 33*a* about the axis V—V, in the direction in which the handle 39*a* moves upward and the housing 30*a* moves downward, is restricted to a desired angular range by abutment of the center leg of the housing supporting fork 31*a* against the bushing support 36*a*. Preferably, the range of downward movement of the housing 30*a* is made such that the housing does not strike any base upon which the rod 82 is mounted.

Figure 7A:
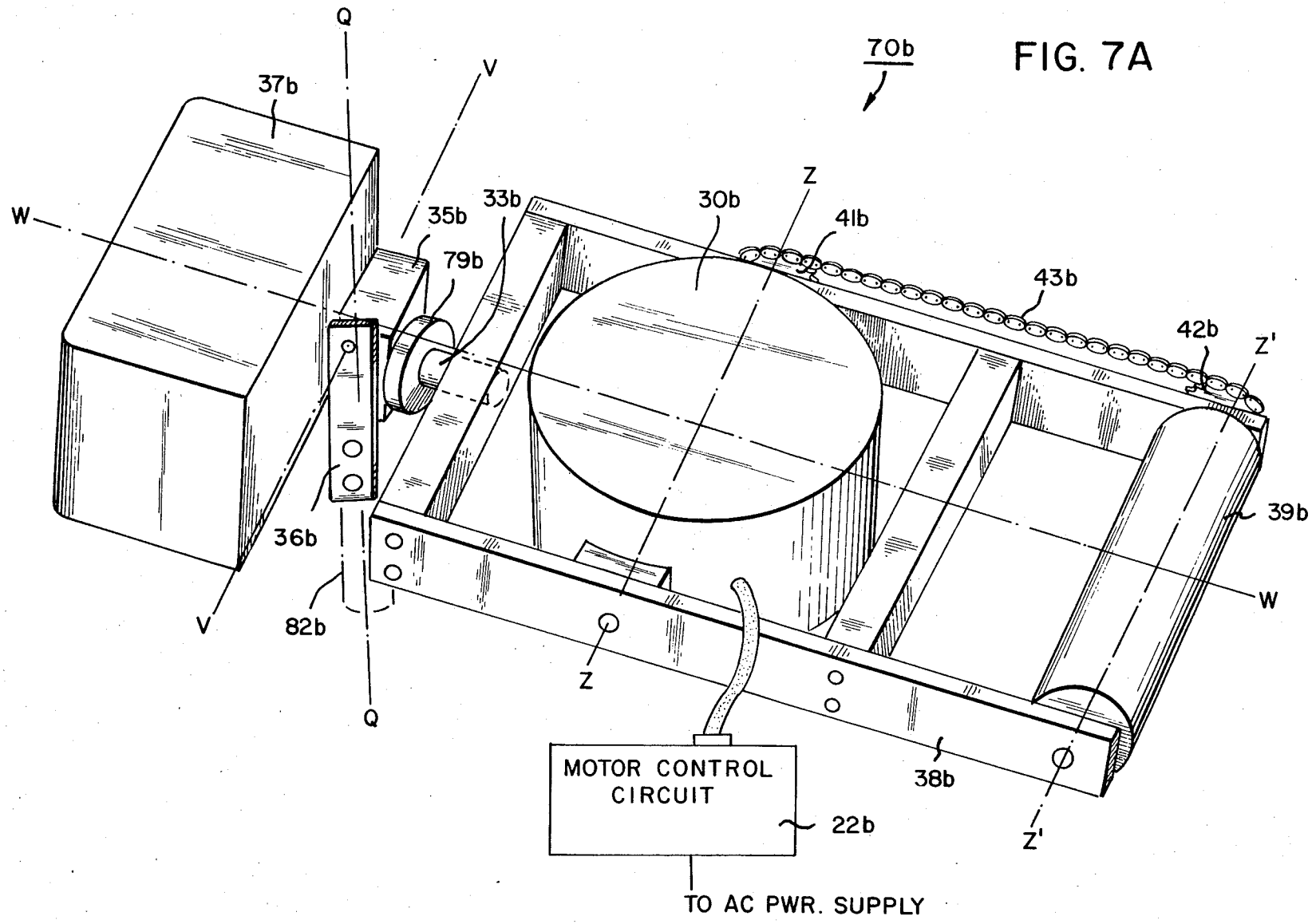
FIG. 7A is a perspective view of a modified form of the precessional exercising device shown in FIG. 7.

FIG. 7A shows a modified form 70*b* of the device 70 shown in FIG. 7. In FIG. 7A, those parts which function in a manner similar (but not necessarily identical) to corresponding parts of the device 70 are given the same numerals followed by the letter "b".

The main difference between the device 70*b* and the device 70 is that whereas in the device 70 the housing 30*a* and the handle 39*a* are located on opposite sides of the pivot axis V—V, in the device 70*b* the housing 30*b* and the handle 39*b* are located on the same side of the pivot axis V—V, and within a common frame 38*b*. The weight of the frame 38*b* and the elements mounted thereon is counterbalanced about the pivot axis V—V by the counterweight 37*b*. Thus the construction of the device 70*b* is somewhat simpler than that of the device 70. However, the operation of the device 70*b* is essentially the same as that of the device 70.

Figure 10:
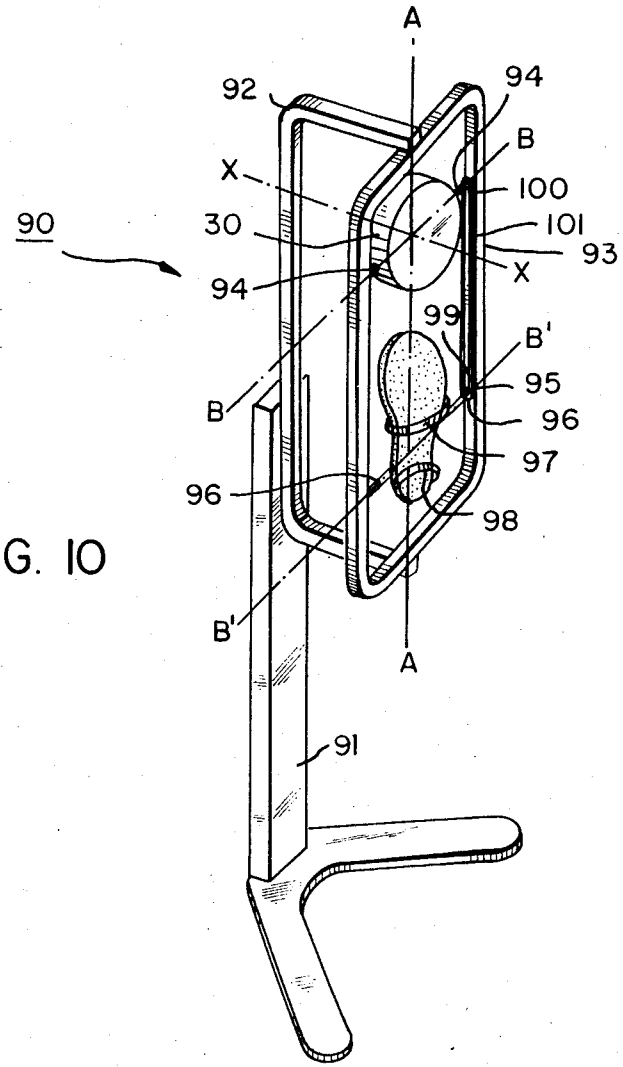
FIG. 10 is a perspective view of a precessional exercising device for the leg, according to a fifth embodiment of the invention.

The fifth embodiment of the invention, shown in FIG. 10, comprises a foot exercise device 90 having a floor stand 91 with an upright to which is secured a U-shaped bracket 92.

A rectangular open frame 93 is pivotally mounted in a vertical plane between the ends of the U-shaped bracket 92, so that the frame 93 is rotatable about the vertical axis A—A.

Within the open frame 93 a housing 30 is disposed, which may be identical in external and internal configuration to the housing 30 shown in FIG. 6. The rotating mass within the housing 30 has an initially horizontal spin axis X—X. The housing is mounted for rotation within the frame 93 about horizontal axis B—B, by means of axles 94.

Also mounted within the frame 93, below the housing 30, is a foot plate 95. The foot plate 95 is mounted for rotation about the horizontal axis B′—B′, which is parallel to the axis B—B, by means of axles 96. Attached to the foot plate 95 are a foot strap 97 and a heel strap 98, for firmly securing the foot to be exercised to the foot plate 95.

The foot plate 95 is bidirectionally coupled to the housing 30 by a sprocket wheel 99 connected to one of the axles 96, a sprocket wheel 100 connected to one of the axles 94, and an endless chain 101 connected between said sprocket wheels. The sizes of the sprocket wheels may be the same or different, depending upon the desired mechanical advantage to be realized in the coupling between the foot plate 95 and the housing 30.

Figure 11:
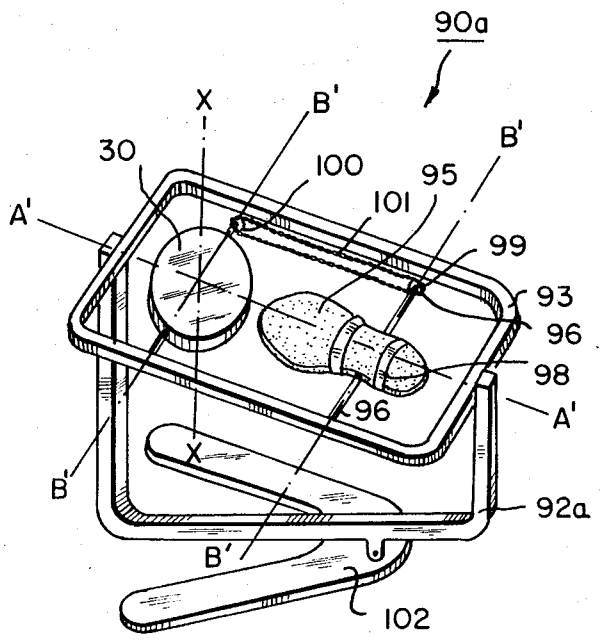
FIG. 11 is a perspective view of a precessional exercising device for the leg, according to a sixth embodiment of the invention, corresponding to a modification of the fifth embodiment.

The sixth embodiment of the invention, shown in FIG. 11 as the device 90*a*, is a modification of the arrangement of FIG. 10, wherein the upright portion of the stand 91 has been eliminated, and the U-shaped bracket 92 is attached directly to a floor stand 102, so that the open frame 93 is initially disposed in a horizontal plane so that the user can stand upright or sit in a chair or on a bench while using the device.

In the devices 90 and 90*a*, turning of the foot plate about the axes B′—B′ and A—A results in precession of the mass within the housing 30, in a manner similar to that previously described with reference to FIG. 6, causing corresponding counter-torques to be applied to the foot plate 95.

In such an exercise, with the foot secured to the foot plate 95 by the straps 97 and 98, controlling of the precessional turning about axis B—B demands a torque about axis B′—B′ from the dorsiflexion/plantarflexion group of the muscles of the foot and leg. Similarly, controlling of the precessional turning about axis A—A demands a torque about said axis from the inversion/eversion muscles of the foot and leg. These torques are directly proportional to the rate at which the angular orientation of the spin axis X—X is being changed by the user.

By reversing the direction of rotation of the mass within the housing 30, the direction of the precessional torque generated by rotational movements of the foot plate 95 is similarly reversed. Thus four modes of foot exercise are available with the devices 90 and 90*a*, namely rotation about the axis B′—B′, rotation about the axis A—A, and performance of said rotations with the direction of spin of the mass within the housing 30 reversed.

The direction of spin of the mass within the housing 30 may be reversed by a suitable control of the motor control circuit 22, which causes the rotating magnetic field generated by the stator winding sections of the motor within the housing 30 to rotate in the opposite direction. Such motor controls are well known in the art and do not comprise any part of the present invention.

Figure 11A:
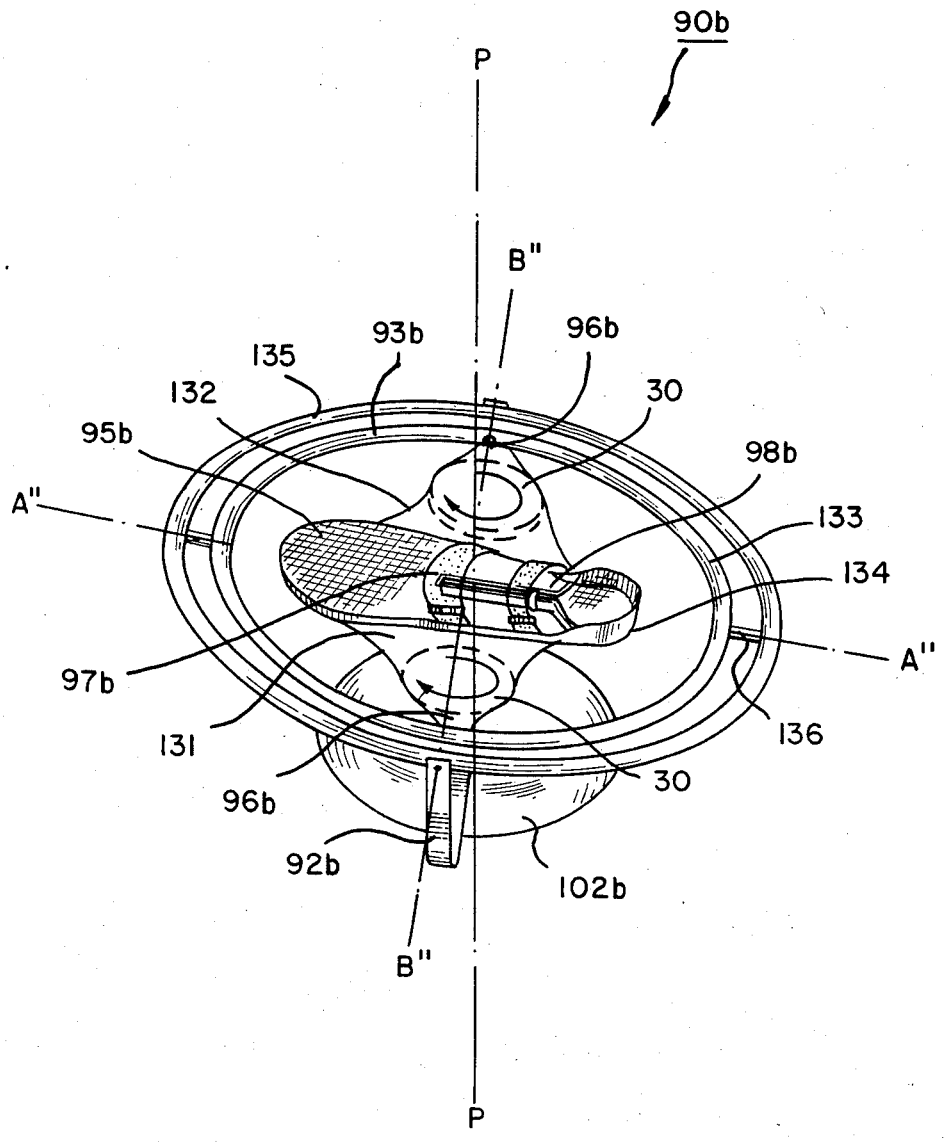
FIG. 11A is a perspective view of a modified form of the precessional exercising device shown in FIG. 11.

FIG. 11A shows a modified form 90*b* of the device 90*a* of FIG. 11. In FIG. 11A, those parts which function in a manner similar (but not necessarily identical) to corresponding parts of the device 90*a* are given the same numerals as such corresponding parts, followed by the letter "b".

In the device 90*b* of FIG. 11A, a foot plate 95*b* has left and right lateral extensions 131 and 132, and an adjustable heel rest 134 which is slidably movable longitudinally of the foot plate 95*b* to accomodate feet of varying size. A foot strap 97*b* and a heel strap 98*b* extend from the foot plate 95*b* and heel rest 134 respectively, for securing a foot to the same.

A housing 30 (identical to the housing 30 shown in FIG. 6) containing a spinning mass is secured to the lower surface of each of the extensions 131 and 132, so that the spinning masses within said housings 30 both spin in the same direction with their spin axes perpendicular to the foot plate 95*b*.

The foot plate 95*b* (and its extensions) is rotatably mounted on an inner gimbal 133 by means of colinear axles 96*b* for rotation about axis B″—B″, so that a line between said axles intersects (or comes closely adjacent to) the spin axes of the spinning masses within the housings 30 mounted on the extensions 131 and 132.

The inner gimbal 133 is rotatably mounted on an outer gimbal 135 by means of colinear axles 136 for rotation about axis A″—A″, so that a line between said axles is colinear with, or to and slightly (less than 1 inch) above the longitudinal center line of the foot plate 95*b*.

The outer gimbal 135 is rotatably mounted on the support 102*b* by means of the bracket 92*b* for rotation about a vertical axis P—P which preferably extends through the longitudinal center line of the foot plate 95*b* and intersects or comes closely adjacent to a line extending between the axles 96*b*.

The device 90*b* is used in a manner similar to that of the device 90*a*, i.e. in a standing or sitting position with the leg secured to the foot plate 95*b* by the straps 97*b* and 98*b*. The foot is rotated about one of the mutually orthogonal axes B″—B″ and A″—A″ (both of which are perpendicular to the spin axes of the housings 30 secured to the extensions 131 and 132), and precessional rotation about the other of said axes is resisted to provide the desired exercise effect. To obtain a complete exercise of the muscles involved, the exercise is repeated with the directions of spin of the masses within the housings 30 reversed.

If desired, the foot plate 95*b* may be modified so that a hand or arm (up to the elbow joint) may be secured thereto for similar exercise of the muscles of the arm.

A cot-like device 110 for exercising the waist, abdominal muscles and back, according to a seventh embodiment of the invention, is shown in FIG. 12.

The device 110 comprises a base 111, a lower body padded deck 112 secured to the base 111, and an upper body padded deck 113, and a foot rest 141 secured to the base 111 adjacent the lower deck 112. A motor control circuit unit 22*a*, similar to the unit 22, is attached ro the base 111 and oriented to that it can readily be operated by the left hand of a user reclining on the decks 112 and 113.

The upper body deck 113 comprises an open frame 120 which is hinged to the lower body deck 112 by a hinge 114, for rotation, about the transverse horizontal axis C—C. A padded inner frame 121 is pivotably mounted within the open frame 120 by axles 115, for rotation of the upper body deck 113 about the longitudinal axis D—D.

A housing 30*c* containing a rotating mass, is mounted to the bottom surface of the inner frame 121. The external and internal structure of the housing 30*c* may be identical to those of the housing 30 shown in FIG. 6, except that the housing 30*c* and its internal rotating mass should be of larger size to generate precessional effects of greater magnitude. The spin axis X—X of the rotating mass within the housing 30*c* should initially be vertical.

Extending from the open frame 120 of upper body deck 113 are left and right balance arms 116 and 117, to the ends of which corresponding counterweights 118 and 119 are attached, to statically balance the weight of the upper body deck 113. The ends of the arms 116 and 117 extend beyond the counterweights 118 and 119, so that additional weights may be placed on said arms to counterbalance rhe weight of the upper body of the user. The additional weights are secured to the arms 116 and 117 by suitable collars (not shown).

Straps 122*a*, 122*b* and 122*c* are provided for securing the user in position on the decks 112 and 113. An adjustable headrest is secured to the inner frame 121.

Twisting of the upper body of the user about axis D—D results in generation of precessional torque about the axis C—C, and vice versa. The direction of the precessional torque depends on the direction of rotation of the rotating mass within the housing 30*c*; which direction can be reversed by a switch 123 on the motor control circuit unit 22*a*.

In exerting the muscles to resist or suppress the precessional torque, the flexor and extensor muscles of the abdomen, waist and back are exercised.

A device 130 according to the eighth embodiment of the invention is shown in FIG. 13, and comprises a base 131 having two spaced craters 132 and 133 in which rest corresponding spherical housings 134 and 135. Control circuits 22*b* and 22*c*, similar to control circuit 22, are disposed within the base 131.

Each of the craters 132 and 133 may be lined with tetrafluoroethylene polymer or another low surface friction material to facilitate rotation of the housings 134 and 135. Alternatively, the surfaces of the craters 132 and 133 may constitute a plurality of ball bearings and an underlying support therefor.

The structure of the interior of each of the housings 134 and 135 may be identical to the internal structure of the device 60 shown in FIGS. 4 and 5. The rotating masses within each of the housings 134 and 135 may have spin axes oriented in any desired direction, since the housings are freely rotatable in the craters 132 and 133.

To exercise using the device 130, the user merely grasps each spherical housing in a corresponding hand and manipulates the housings in various angular directions in their craters, giving rise to corresponding precessional torques which can be resisted or suppressed by the user to exercise the flexor and extensor muscles of the hand and arm.

Since it is not necessary to lift the housings out of their craters to obtain the beneficial effects of the exercise, the device 130 is especially suitable for use by the disabled, in that there is no risk of dropping the housings, and the risk of injury due to the exercise is minimal.

In all of the devices described above, the speed of rotation of the rotating mass(es) may be varied to provide torques suitable for the strength and level of experience of the user, with the torques being increased as the user's strength and experience grow.

What is claimed is:

1. A device for exercising the muscles associated with the foot by resisting precession torque generated by the device, comprising:

a housing;

bearing means within the housing;

a mass within the housing and supported by said bearing means for rotation about a spin axis, said mass being dynamically balanced about said spin axis;

means for rotating said mass about the spin axis;

frame means having housing support bearing means supporting said housing for rotation about a first axis coaxial with said housing support bearing means and perpendicular to said spin axis;

a foot support member;

means for detachably securing a foot to said foot support member;

said frame means having foot support member bearing means supporting said foot support member for rotation about a foot support member axis parallel to said first axis;

a support;

said frame means being mounted to said support for rotation about a second axis perpendicular to said first axis and said foot support member axis and passing through the centroid of mass of said housing; and transmission means connected between the foot support member and the housing for bidirectionally coupling angular rotation of the foot support member about the foot support member axis to angular rotation of the housing about the first axis through a corresponding angle proportional to the angle of rotation of the foot support member;

whereby a leg secured to the foot support member may be exercised by rotating the foot support member about foot support member axis and resisting the resulting torque applied to said foot support member about said foot support member axis and second axis due to the generation of precessional torque by said mass.

2. The device according to claim 1, wherein said transmission means comprises a first wheel mounted for rotation with said housing about said first axis, a second wheel mounted for rotation with said foot support member aoout said foot support member axis, and an endless belt or chain interconnecting said wheels.

3. A device for exercising the muscles associated with the leg by resisting precession torque generated by the device, comprising:

first and second housings;

bearing means within each of said housings;

a mass within each of said housings and supported by the corresponding bearing means for rotation about a corresponding spin axis, each said mass being dynamically balanced about the corresponding spin axis;

means fcr rotating each said mass about the corresponding spin axis;

a foot support member having first and second extensions with a foot receiving portion therebetween;

said first and second housings being mounted on said first and second extensions respectively, with the spin axes of said masses parallel to each other;

means for detachably securing a foot to said foot receiving portion of said foot support member;

a first support member having foot support member bearing means supporting said foot support member for rotation about a first axis perpendicular to said spin axes; and a second support member having first support member bearing means supporting said first support member for rotation about a second axis perpendicular to first axis and said spin axes;

whereby a log secured to the foot receiving portion of the foot support member may be exercised by rotating the foot support member about at least one of said first and second axes and resisting the resulting torque applied to said foot support member about the other of said first and second axes due to the generation of precessional torque by said masses.

4. A device for exercising the muscles associated with a movable part of the body by resisting precession torque generated by the device, comprising:

first and second housings:

bearing means within each of said housings;

a mass within each of said housings and supported by the corresponding bearing means for rotation about a corresponding spin axis, each said mass being dynamically balanced about the corresponding spin axis;

means for rotating each of said mass about the corresponding spin axis;

a body portion support member having first and second extensions with a movable body part receiving portion therebetween;

said first and second housings being mounted on said first and second extensions respectively, with the spin axes of said masses parallel to each other;

means for detachably securing a movable part of the body to said movable body part receiving portion of said body portion support member;

a first support member having body portion support member bearing means supporting said body portion support member for rotation about a first axis perpendicular to said spin axes; and a second support member having first support member bearing means supporting said first support member for rotation about a second axis perpendicular to first axis and said spin axes;

whereby a movable part of the body secured to the movable body part receiving portion of the body portion support member may be exercised by rotating the body portion support member about at least one of said first and second axes and resisting the resulting torque applied to said body portion support member about the other of said first and second axes due to the generation of precessional torque by said masses.

5. The device according to claim 3 or 4, wherein said mass rotating means is adapted to rotate said masses in the same direction.

6. A device for exercising the muscles associated with a movable part of the body by resisting precession torque generated by the device, comprising:

at least one housing;

bearing means within said housing;

a mass within said housing and supported by said bearing means for rotation about a corresponding spin axis, said mass being dynamically balanced about said spin axis;

means for rotating said mass about said spin axis;

body portion support means having a movable body part receiving portion;

said housing being mounted on said body portion support means;' means for detachably securing a movable part of the body to said movable body part receiving portion of said body portion support means;

a first support member haaving body portion support means bearing means supporting said body portion support means for rotation about a first axis perpendicular to said spin axis; and a second support member having first support member bearing means supporting said first support member for rotation about a second axis perpendicular to first axis and said spin axes;

whereby a movable part of the body secured to the movable body part receiving portion of the body portion support means may be exercised by rotating the body portion support means about at least one of said first and second axes and resisting the resulting torque applied to said body portion support means about the other of said first and second axes due to the generation of precessional torque by said masses.

7. A device for exercising the muscles associated with the foot by resisting precession torque generated by the device comprising:

a support;

an intermediate supporting structure comprising an intermediate supporting member mounted on said support for rotation about at least one axis;

a housing;

bearing means within the housing;

a mass within the housing and supported by said bearing means for rotation about a spin axis, said mass being dynamically balanced about said spin axis;

means for rotating said mass about the spin axis;

connecting means for connecting said housing to said intermediate supporting structure and for rotatably supporting said housing such that said housing is rotatable relative to said intermediate supporting member only about a first axis and a second axis, said first axis passing through the centroid of mass of said housing and perpendicular to said spin axis, said second axis passing through the centroid of mass of said housing and perpendicular to both said spin axis and said first axis;

a foot plate haaving an axis of rotation parallel to said first axis, said foot plate being mounted on said intermediate supporting structure for rotation about two mutually orthogonal axes, one of said orthogonal axes being spaced apart from said first axis;

means for securing a foot to said foot plate; and coupling means operatively associated with said intermediate supporting structure for bidirectionally linking said actuator means to said housing, so that (i) angular rotation of said actuator means about two mutually orthogonal axes results in corresponding angular rotation of said housing about said first and second axes respectively, and (ii) any precessional torque generated by said mass about said first and second axes is coupled to said actuator means so as to apply corresponding amounts of torque to said actuator means about respective ones of said mutually orthogonal axes;

whereby the foot may be exercised by rotating the foot plate about said mutually orthogonal axes and resisting the resulting torque applied to said foot plate about said mutually orthogonal axes via said coupling means due to the generation of precessional torque by said mass.

* * * * *